United States Patent [19]

Laughlin

[11] 4,288,762

[45] Sep. 8, 1981

[54] WIDEBAND 180° HYBRID JUNCTIONS

[75] Inventor: Gordon J. Laughlin, Columbia, Md.

[73] Assignee: The United States of America as represented by the Secretary of the Navy, Washington, D.C.

[21] Appl. No.: 139,309

[22] Filed: Apr. 11, 1980

Related U.S. Application Data

[62] Division of Ser. No. 945,964, Sep. 26, 1978, abandoned.

[51] Int. Cl.[3] ..... H01P 5/19

[52] U.S. Cl. ..... 333/117; 333/121; 333/123

[58] Field of Search ..... 333/117, 121, 123

[56] References Cited

U.S. PATENT DOCUMENTS 3,497,832 2/1970 Cohn ..... 333/121

OTHER PUBLICATIONS

Laughlin, A New Impedance-Matched Wide-Band Balun and Magic Tee, IEEE Trans. on MTT, 3/76, pp. 135-141.

*Primary Examiner*—Paul L. Gensler

*Attorney, Agent, or Firm*—R. S. Sciascia; William T. Ellis; Vincent J. Ranucci

[57] ABSTRACT

Coaxial, impedance-matched, four-port 180° hybrid junctions for multioctave bandwidth operation include a gap in the outer shields of a port and a stub line at their interface for forming a uniform electric field within the gap. This gap and the interconnections between inner conductors and shields of certain ports and the stub, and the lengths of the port and stub lines are such that power input to a first port divides equally and in phase between two other ports with matched impedances and no power is at present at the fourth port. Similarly power fed into the fourth port divides equally, but 180° out of phase, between the two other ports with matched impedances and no power is present at the first port.

4 Claims, 4 Drawing Figures

WIDEBAND 180° HYBRID JUNCTIONS

This is a division of application Ser. No. 945,964, filed 9/26/78, now abandoned.

BACKGROUND OF THE INVENTION

This invention relates generally to hybrid junctions and especially to coaxial 180° hybrid junctions for impedance-matched, multioctave bandwidth operation.

Existing hybrid junctions are formed from waveguides or coaxial cables. Although use of coaxial cables is preferred for wideband applications, many wideband hybrid junctions are formed from waveguides. Yet even conventional waveguide designs are not suitable for octave or multioctave operation, in which case ridged waveguides are used. Conventional and ridged waveguide configurations may be too large and inconvenient for many wideband applications. Existing coaxial devices for 180° phase shifts generally apply to narrowband use. It may be possible to modify such coaxial hybrid junctions for wideband use, but at the expense of complex fabrication (i.e., multicoupler networks).

SUMMARY OF THE INVENTION

It is the general purpose and object of the present invention to provide impedance-matched coaxial hybrid junctions for wideband, multioctave operations. An advantage of the present invention is that the coaxial design permits small, compact and convenient configurations. Another advantage is that the device can be made to operate at all microwave frequencies (100 MHZ to about $3\times10^5$ MHZ).

These and other objects and advantages of the present invention are accomplished by a hybrid junction with four ports and a stub formed from coaxial cable, the device having a gap in the outer shield of one of the port lines and the stub line at the interface of the two lines. A uniform electric field forms across the gap so that the voltages induced at the two output ports are equal and either in phase or 180° out-of-phase depending on which of the two other ports is the input.

Other objects and advantages of the invention will become apparent from the following detailed description of the invention when considered in conjunction with the accompanying drawings wherein:

DETAILED DESCRIPTION OF THE INVENTION

Figure 1:
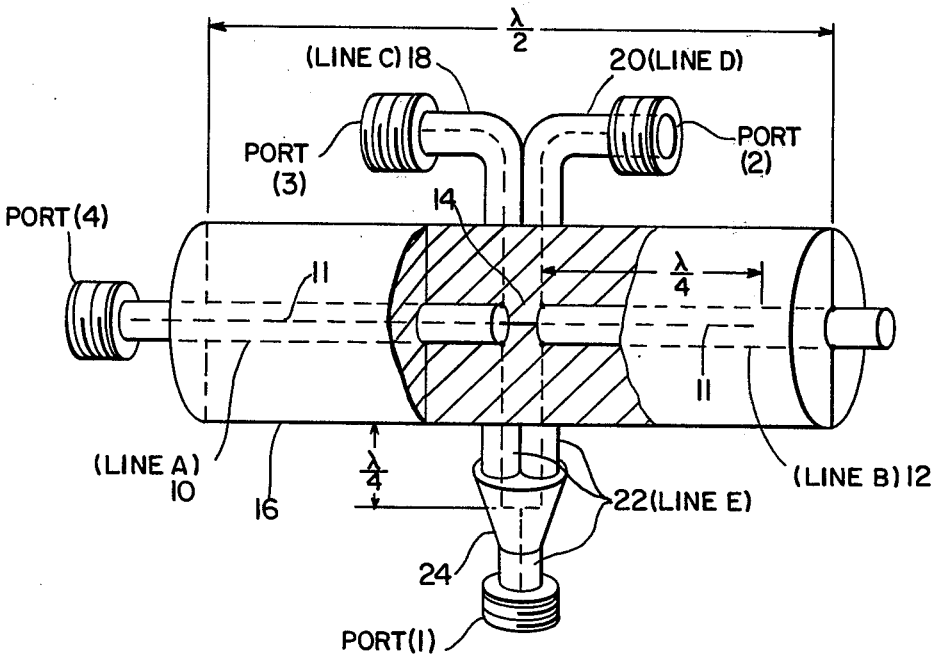
FIGS. 1-4 are schematic illustrations of four coaxial embodiments of the invention.

Referring now to the drawing, FIG. 1 shows the first embodiment of the present invention. Lines A(10) and B(12) are formed from a single coaxial cable of suitable diameter having a gap 14 in the outer shield at the center of the device. The gap 14 is small relative to the wavelength, nominally $\lambda o/10$ in length, where $\lambda$ is the wavelength at the highest frequency of operation. The inner conductor 11 of line A is also the inner conductor of line B. The length of the inner conductor of line B which extends from the tip of the shield of line B at the gap to an unconnected, that is open-circuited, point within the shield is $\lambda/4$, where $\lambda$ is the wavelength at the central frequency of the frequency band. The quarter wavelength of the inner conductor of line B may be replaced by shorting the inner conductor of line A to the shield of line B at the gap. A cylindrical cavity 16 of $\lambda/2$ in length and having a cap at each end coaxially encloses lines A and B such that lines A and B extend through the end caps and the outer shields of lines A and B connect to the end caps. The cavity may contain a dielectric material other than air and has an outer shield of metal.

Line C (18) is the same length as line D (20). The shields of lines C and D are connected to the shield of the cavity but are not enclosed by the cavity. The inner conductors of lines C and D enter the cavity and are shorted to the shields of lines A and B, respectively. Line E branches into two paths at a junction 24 so that each path couples to the cavity. The shields of both paths of line E connect to the shield of the cavity but are not enclosed by the cavity. The inner conductors of both paths of line E enter the cavity and the inner conductor of one path of line E connects to the shield of line A while the inner conductor of the second path of line E connects to the shield of line B. The distance from the point of line E at which both paths of line E are common within the junction to the shield of the cavity is $\lambda/4$. The tips of lines A, C, D, and E correspond to ports 4, 3, 2 and 1, respectively whereas line B is a stub. The connectors at ports 2, 3 and 4 are standard. Ports 2 and 3 are equidistant from the cavity.

The cavity controls the current within the shield of lines A and B by inhibiting the device from radiating. The cavity thereby contributes to the impedance-matching and wide bandwidth of the device.

Line B is an open-circuit stub of 80 /4 in length which further contributes to impedance-matching. At the center of the frequency bank the $\lambda/4$ length of line B transforms the open circuit to a short circuit as the gap. At frequencies off band center the characteristic impedance of the open circuit stub may be adjusted to interact with the cavity and other circuit lines to improve impedance-matching over a wide bandwidth.

In operation, power sent into port 1 splits equally between the inner conductors of line E from which the power passes to lines C and D and exits through ports 2 and 3 in phase. No power is coupled into port 4 because no voltage is generated across the gap between lines A and B and thus no voltage from inner conductor to shield is effected in line A. The $\lambda/4$ length portion of line E transforms the matched loads of ports 2 and 3 to a matched load at port 1. On the other hand, power fed into port 4 excites a voltage across the gap between lines A and B and between the inner conductors of lines C and D and their shields. The $\lambda/4$ length open circuit of line B appears as a short circuit at the gap. The power out of ports 2 and 3 will be equal in amplitude but in anti-phase. Port 1 will receive the power generated at port 2 on one path of line E and port 3 on the other path. Because the paths are joined a distance $\lambda/4$ from the gap, the anti-phase components will cancel each other and no power will be delivered to port 1. By properly selecting line impedances for ports 2 and 3, port 4 will be impedance-matched.

Figure 2:
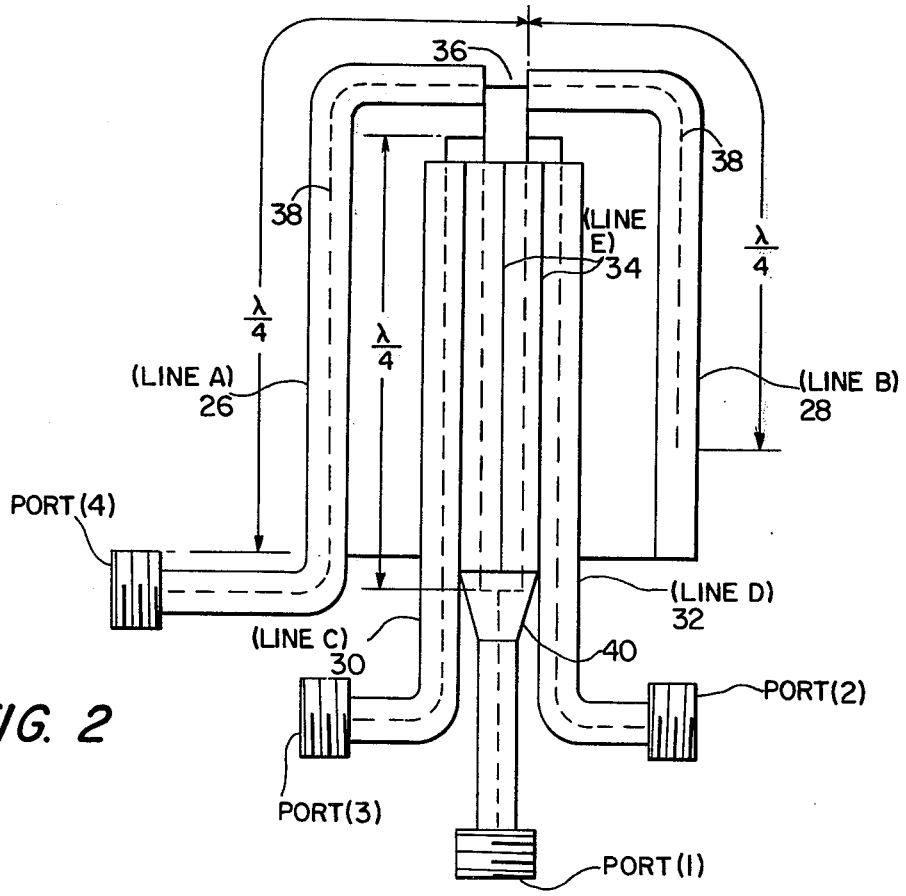
Figure 3:
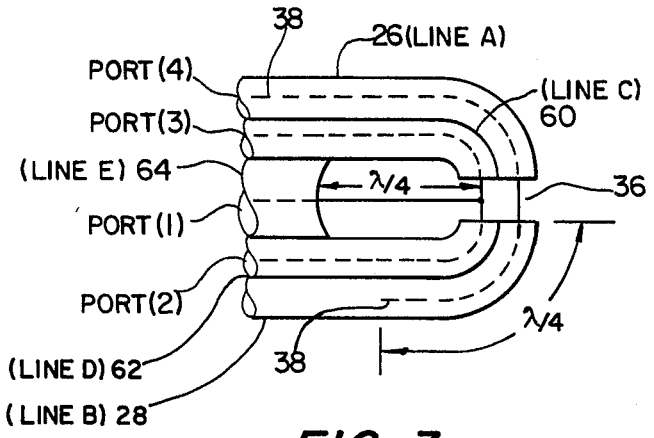
Figure 4:
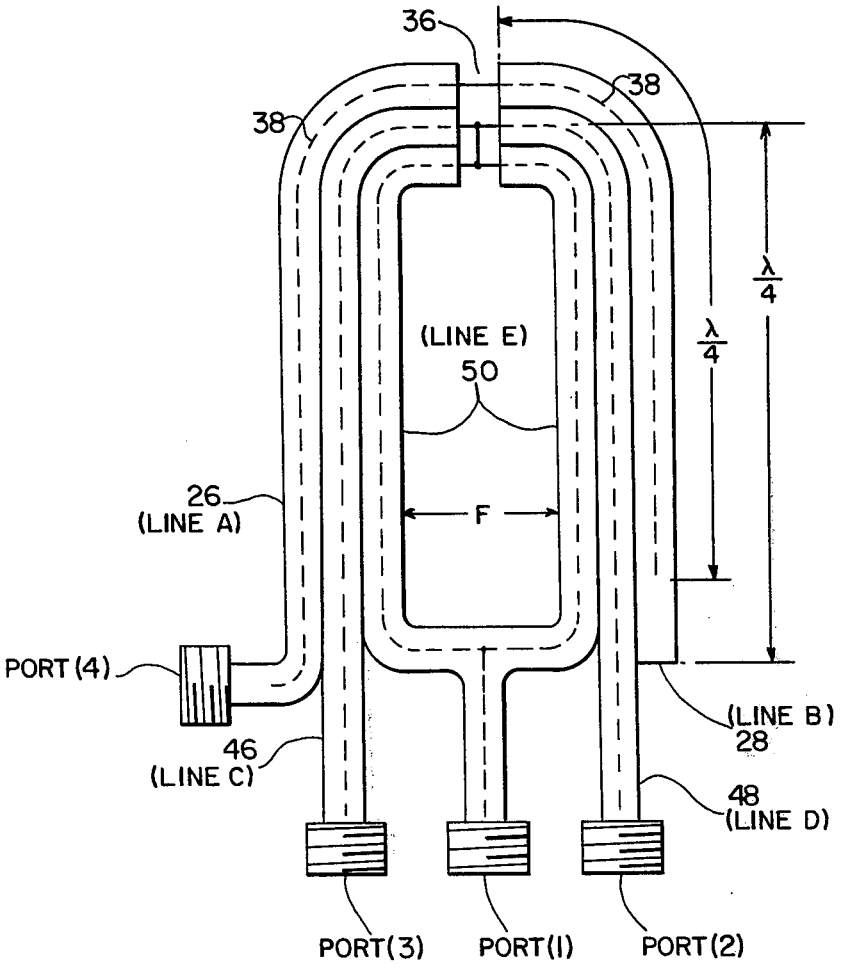

In FIGS. 2, 3 and 4 which depict other embodiments of the present invention, lines A (26) and B (28) are formed from a single coaxial cable of suitable diameter and are separated by a gap 36 in the other shield at the center of the device. The inner conductor 38 of line A is also the inner conductor of line B. The length of the inner conductor of line B which extends from the tip of the shield of line B at the gap to an unconnected, that is open-circuited, point within the shield is $\lambda/4$, and that length enhances the impedance-matching capabilities of the device over a wide bandwidth as in FIG. 1. However, as in FIG. 1 the quarter wavelength of the inner conductor of line B may be replaced by shorting the inner conductor of line A to the shield of line B at the gap. In FIG. 2 the inner conductor of line E (34) is split into two paths within a junction 40 as in FIG. 1. The inner conductor of one of the paths of line E connects directly to the inner conductor of line C (30) and to the shield of line A. The inner conductor of the second path of line E connects directly to the inner conductor of line D (32) and to the shield of line B. The shields of lines C, D and E are electrically joined along their lengths in the active region of the device. The shields of lines A and B are electrically joined together and to the shields of lines C, D and E at points nominally λ/4 from the gap. Line C is equal in length to line D.

In this embodiment the cavity, shown in FIG. 1, is open and is formed by the outer shields of lines A and B.

This device is electrically similar in operation to the first embodiment.

FIG. 3 depicts the third embodiment of the present invention. Lines C (60) and D (62) are formed from a single coaxial line with a gap in the outer shield that is aligned with the gap between lines A (26) and B (28). Lines C and D have a common inner conductor. The outer shields of lines A and C are electrically joined as are the shields of lines B and D. Line E (64) is formed from a coaxial cable symmetrically placed between lines C and D. The inner conductor of line E is electrically joined to inner conductor of lines C and D in a symmetrical manner at the gap between lines C and D. Line E has no shield along its inner conductor for a nominal distance of λ/4 from the point at which the inner conductor joins the inner conductor of lines C and D. However, the remaining shield of line E joins the shields of lines C and D.

In order to prevent the device from radiating, a metal shield (not shown) may enclose the device from the point where the shield of line E ends at approximately λ/4 from the gaps.

In operation, when power is sent into port 4 an electric field is excited across the gap between lines A and B. This electric field couples the power into output lines C and D having equal amplitude and in anti-phase. Lines C and D appear as series impedances across the gap. The short circuited quarter wavelength of lines A, B, C and D shunts the gap and for a quarter wavelength the shunting impedance is infinite. Line E does not appear to the remainder of the device in this operation because line E is balanced between lines A and C and lines B and D, and no power is propagated in line E beyond the short circuit.

When power is sent into port 1 lines A and C and lines B and D are at the same potential. Consequently, driving line E does not excite a field across the gap. Since the shields of output lines C and D are common with the ground of input line E, and the inner conductors of lines C, D and E are common, lines C and D appear in parallel to line E. Therefore, the power couples into lines C and D with equal amplitude and in phase. However, because no field is excited across the gap between lines A and B, no power is coupled from line E to line A.

FIG. 4 shows the fourth embodiment of the present invention. Lines C (46) and D (48) are equal in length and have a common inner conductor. A gap in the shields of lines C and D is aligned with the gap between lines A and B. Line E (50) splits into two equal paths having a gap in the outer shield which is aligned with the gaps between lines A and B and lines C and D. The inner conductor of lines C and D is symmetrically connected to the inner conductor of line E at the gaps between lines C and D and between the paths of line E. The shields of lines A, B, C, D and E are electrically connected. The spacing F which separates the paths of line E must be a length which provided impedance-matching for the device.

In order to prevent the device from radiating, a metal shield (not shown) may enclose the device from about the point where the shields of both paths of line E are joined at about λ/4 from the gaps.

Operation of this device is similar to the operation of the device of FIG. 3.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. An impedance-matched 180° hybrid junction comprising:

first, second, third and fourth electrically conductive arms, each arm terminating in a port, and a stub arm, the arms being formed from transmission lines having inner and outer conductor means, said first arm interfacing with said stub arm such that the inner conductor means of said first arm is connected to the inner conductor means of said stub arm, said second arm interfacing with said third arm such that the inner conductor means of said second arm is connected to the inner conductor means of said third arm, the outer conductor means of said first arm and said stub arm having a gap at the interface of said first arm and said stub arm, the outer conductor means of said second and third arms having a gap at the interface of said second and third arms, said gaps being at the center of the hybrid junction, and said gaps being small in length, approximately ten percent of the wavelength at the highest frequency of operation, the inner conductor means of said second and third arms being connected to the inner conductor means of said fourth arm at the center of said gap in the outer conductor means of said second and third arms, said fourth arm having no outer conductor means along its inner conductor means for a distance of λ/4 from the connection point of the inner conductor means of said fourth arm and the inner conductor means of said second and third arms, λ being the wavelength at a central frequency of a frequency band of operation, the outer conductor means of the first and second arms and the outer conductor means of said fourth arm being joined, and the outer conductor means of the third and stub arms and the outer conductor means of said fourth arm being joined, such that power sent into the port of said first arm is transmitted in equal amplitude but in anti-phase to said second and third arms and no power is transmitted to said fourth arm, and such that power sent into the port of said fourth arm is transmitted in equal amplitude and in phase to said second and third arms and no power is transmitted to said first arm.

2. The hybrid junction as recited in claim 1, wherein said transmission lines are coaxial cable, said gaps being in the outer shield of the cable.

3. The hybrid junction as recited in claim 1, wherein said inner conductor means of said stub arm extends a length of $\lambda/4$ from the tip of said outer conductor means of said stub arm at said gap between said first arm said stub arm to be unconnected, open-circuited point within the outer conductor means of said stub arm.

4. The hybrid junction as recited in claim 1, wherein said second arm and said third arm are the same length.

* * * * *